US006470665B2

(12) United States Patent
Cremasco

(10) Patent No.: US 6,470,665 B2
(45) Date of Patent: Oct. 29, 2002

(54) PROCEDURE TO OBTAIN THE DIAMOND EFFECT IN A PRECIOUS METAL PRODUCT, PARTICULARLY AS IN A CHAIN WITH HOLLOW LINKS AND A CHAIN OBTAINED ACCORDING TO SAID METHOD

(75) Inventor: Pietro Cremasco, Mussolente (IT)

(73) Assignee: Filk SpA, Mussolente (VI) (IT)

( * ) Notice: Subject to any disclaimer, the term of this patent is extended or adjusted under 35 U.S.C. 154(b) by 0 days.

(21) Appl. No.: 09/860,675

(22) Filed: May 21, 2001

(65) Prior Publication Data

US 2001/0052227 A1 Dec. 20, 2001

(30) Foreign Application Priority Data

Jun. 9, 2000 (IT) ..... TV00A0065

(51) Int. Cl.[7] ..... B21L 15/00
(52) U.S. Cl. ..... 59/35.1; 59/29; 59/80
(58) Field of Search ..... 59/3, 35.1, 80, 59/82, 29

(56) References Cited

U.S. PATENT DOCUMENTS 2,711,069 A * 6/1955 Armbrust ..... 59/35.1
5,526,639 A * 6/1996 Gonzales ..... 59/35.1
5,581,992 A * 12/1996 Borouchov ..... 59/29
5,581,993 A * 12/1996 Strobel ..... 59/35.1
5,653,100 A * 8/1997 Dal Monte ..... 59/30
5,911,677 A * 6/1999 Kupelian ..... 59/35.1
5,966,922 A * 10/1999 Cossio ..... 59/35.1
6,263,658 B1 * 7/2001 Rosenwasser et al. ..... 59/80

* cited by examiner

*Primary Examiner*—David Jones
(74) *Attorney, Agent, or Firm*—Harrison & Egbert

(57) ABSTRACT

Procedure to obtain the diamond effect on a precious metal chain with hollow links, that includes the following phases:

Advancing step by step of a semi-manufactured product chain made of hollow links, by means of a cold moulding station;

At each stop, in the moulding station, carrying out in logical correspondence the descent towards a matched mould, of at least one core and at least one mould, in which the core can be moved perpendicularly through the mould, placed inside each individual link of the corresponding segment of chain, disposing the perimeter surface in contact with the interior perimeter of each link;

Lowering the mould with simultaneous deformation and disposition of each link;

Partially raising the core, with the mould and matched mould remaining in closed position;

and ending the ascension of the core until extraction of the corresponding link, with ascension towards the top part of the mould for a successive cycle that must be carried out on the segment of successive links.

12 Claims, 2 Drawing Sheets

PROCEDURE TO OBTAIN THE DIAMOND EFFECT IN A PRECIOUS METAL PRODUCT, PARTICULARLY AS IN A CHAIN WITH HOLLOW LINKS AND A CHAIN OBTAINED ACCORDING TO SAID METHOD

BACKGROUND OF THE INVENTION

1. Field of the Invention

The present invention relates to a procedure to obtain the diamond effect in a precious metal product, particularly as in a chain with hollow links.

The invention has a particular but not exclusive application in the field of jewelry, and in general in the industrial manufacture of precious metals for mass production of chains.

2. Description of Related Art

Chains such as manufactured products of precious metals are known in most fields, and particularly amongst the female population. It is also known that, at the moment, there are many types of chains available on the market, some are very prestigious, produced with the most traditional techniques, others are less prestigious, which being produced by appropriate machinery give place to products that normally remember ornamental motives present for a long time.

The chains either of the first or second type or as an accessory product for personal embellishment, are composed of links freely linked between them, even in a discontinuous manner and sometimes not uniformly, in whose extremities are linked closing terminals in the form of a ring of different shapes. In the complex panorama of the products that exist today, there are two types of chains, known as solid and hollow. The main difference between them is therefore intuitive in the sense that the first requires the use of a bigger amount of raw material, while the second requires much less for an equal size. For this reason a substantial difference in the purchase price is evident, allowing a wider range of buyers to enjoy these valuable products, who otherwise would not be able to buy them because of their inaccessible price.

The companies of this sector, who are particularly intent on the orientation of the public's taste, have for a long time understood the necessity of offering the market products that in some way are more appreciated, such as an unusual shine of the metal. This exaltation of the property can be achieved today directly on the metal, carrying out works that substantially confer a diamond effect on the surface of the metal.

This peculiar aesthetic effect in the widest meaning of the term is known thus for a long time, and owes its origin to the more than famous diamond, which amongst its characteristics reflects light in several directions offering said sensation of shining and vivacity unique in its kind. When transferring these effects to other precious metals, as for example gold, there is no doubt that the latter gains value and acquires aesthetic connotations different than normal.

For this reason it seems understandable that both the companies and the creators are rather active producing this product, to the extent that a good part of the manufactured products proposed today present this effect.

Amongst the most recurrent techniques for executing said elaboration is the elimination of chips. This is obtained with diamond tools and allows the elimination of material on one or more sides producing in one case an enhanced specular surface, and in the other case a multiplication of the flat sides of each link. These fine cuttings, obtained for each link, if exposed to light allow a decisive increase of luminosity, which a user can enjoy quantitatively and as a whole in the dimensions of more useful surfaces for the dissemination of the light rays.

Other techniques, for example, can use tools that produce a deformation more or less wide of the surface. Said techniques can include traditional presses that with the aid of a mould and a matched mould for the foreseen objective, deform the surfaces on one or more sides, obtaining, for example, the execution of more sides on a same link. Other manufacture techniques, let us say of low relief, can foresee located microscopic deformations of the metal so as to achieve a surface provided with a plurality of small normally asymmetric incisions, each one being cut. Said tools, in this last case according to the execution technique, or depending if it is handcrafted or industrial, may consist of, for example for the first one, a type of burin that worked repetitively on the corresponding surface produces the desired diamond effect. On the contrary, for industrial manufacturing techniques a different type of tool is required, which in this case comprises more drills conveniently formed, each one to make a small cut orifice.

Another elaboration technique to reproduce the diamond effect consists in preparing a bath in which the surfaces of the products come into contact with chemical agents. The latter lightly modify substantially the surface of the product that has contacted the liquid giving it an unusual aesthetic value quite similar to the first ones, but in anyway different to the one usually defined in this way.

Other techniques in use foresee the use of extremely high precision instruments for the superficial micro-incision of one or more sides of the manufactured product.

Substantially, the use of the abovementioned techniques limits the types of products treated with this method. For example, this is the case of the hollow chains, to which not all of them can be applied, in detriment of a good part of the market, as they are one of the most widespread products.

For example, a first problem that has to be surmounted comes from the fact that the thickness of each link is quite small. This circumstance, in the hypothetial of use of sandpaper, would not allow totally the carving of the surfaces, with the risk that the cavity may emerge. On the other hand, whenever possible, the execution of flat sides would be possible only with a slight inclination with respect to the adjacent plane, so imperceptible that to such a point it would be in detriment of each finality of the elaboration.

Furthermore, in other solutions such as the case of using tools destined to exert pressure on the surfaces, the uncontrolled deformation of each link would inevitably be determined, creating a product that is not uniform and that is of a deficient quality.

The objective of the present invention, in part based on the teachings of certain known techniques, consists thus in allowing to carry out the diamond effect even when used on the chains of the hollow type.

At present no satisfactory techniques are known that allow the industrial manufacture of chains to achieve carved surfaces that create a diamond effect.

On the contrary, a manufacture procedure is known to deform the links of a chain which is referred to by means of the Italian patent application Number TV94A000075 (Filk). It describes a method to deform the links of a chain, as well as a chain with aligned and coplanar links obtained in this way that foresees the following production phases:

Advance step by step of a chain;

On each stop, carrying out in logical correspondence the descent of a chain press and of a punch, in which, due to said punch being coaxial to the chain press, it is apt to be introduced in the inside of each individual link;

Subsequent descent of the press chain and of the punch, with the subsequent deformation and simultaneous disposition of the link;

Partial ascension of the punch as the chain press keeps the corresponding link pressed downwards;

Completion of the ascending of the punch until it extracts the link and the ascension of the chain press for a new successive cycle that must be carried out on the following link;

and in which, being a chain with alternate links, it is established at the end of the previous cycle the eventual transfer in octagonal sense of the supporting carriage and of the movement of the multiple head of the mould, being foreseen at least a second group of tools for a cycle of compression and disposition of a following link different to the previous one so that finally the advance and positioning of a new link is allowed.

For this reason, in this case a mould and a matched mould must be used, being inside the first one a punch that can be moved vertically. Said movement was destined to insert the punch, little by little, which closed the moulds in the inside of each of the links forcing them so that their surface was enough, throughout the inside perimeter. The objective of said manufacture thus was to deform lightly the links of a chain so as to allow them to remain perfectly aligned and in coplanar form with respect to each other, avoiding the known phenomenon of twisting.

BRIEF SUMMARY OF THE INVENTION

This and other objectives are achieved by means of the present invention from the characteristics of some of the annexed claims, solving the problems exposed by means of a procedure to achieve a diamond effect on a precious metal product, as occurs particularly in a chain of hollow links, that comprises the following production phases:

Advancing step by step of a semi-manufactured product chain made of hollow links, by means of a cold moulding station;

At each stop, in the moulding station, carrying out in logical correspondence the descent towards a matched mould, of at least one core and at least one mould, in which said nucleus can be moved perpendicularly through the mould, is placed inside each individual link of the corresponding segment of chain, disposing the perimeter surface in contact with the interior perimeter of each link;

Lowering of the mould with simultaneous deformation and disposition of each link;

Partially raising the core, with the mould and matched mould remaining in closed position; and Ending of the ascension of the core until extraction of the corresponding link, with ascension towards the top part of the mould for a successive cycle when acting on the segment of successive links.

In this way, several advantages are achieved by means of the notable creative contribution whose effect constitutes an immediate technical progress.

Firstly, cold deformations can be made on a chain of hollow links, conferring on them valuable and original aesthetic effects that could not otherwise be achieved, such as the diamond effect. In more detail, said controlled deformations are carried out to obtain more fine cuttings on the surfaces of a flat chain, so that the capacity to reflect light is increased and, to sum up, the quality is enhanced.

Consequently, with the increase of luminosity and with a manufactured product of such quality the desires of a wide range of consumers can be satisfied with a moderate cost. These consumers can enjoy jewels that not only enhance the aesthetic characteristics in their simplicity, but also make possible that the peculiarities of the design are appreciated. In the same way, these particularities allow to optimization the exposition in the shops, whose group of reflections and colours draw the attention of the potential buyer.

Finally, it is a manufacture that can be carried out for great quantities without increasing substantially the duration of traditional productions. This means a reduction of expenses for the company, who can invest positively with respect to a reduction of the purchase cost for the buyer.

These and other advantages will appear in the following detailed description of a preferred embodiment with the aid of the annexed diagrammatic drawings which are to be understood as a non-limiting example.

BRIEF DESCRIPTION OF THE SEVERAL VIEWS OF THE DRAWINGS

Finally.

DETAILED DESCRIPTION OF THE INVENTION

The present invention requires the predisposition upstream of the manufacturing cycle of a semi-elaborated product (A) composed of a traditional precious metal chain, as for example gold, made of symmetric hollow links each linked to one another (1) or of the intermediate type of links with different size than the previous ones.

The chain (A) established in this way, unfolded by a blade, is conducted throughout a transport line (x) towards a moulding station, inside of said moulding station said chain (A) suffers a process of cold deformation to obtain in the lateral side of each link (1) at least one flat side (11) on an oblique plane, so that the user obtains what is defined in the present invention as the diamond effect on the chain made of hollow links.

Figure 1:
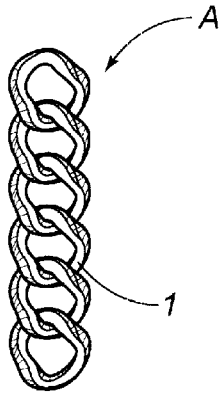
FIG. 1 is a plan view of a part of the chain, semi-elaborated in the form of uniform, hollow links.
Figure 4A:
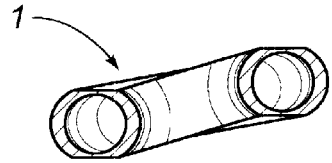
FIG. 4A is a view, always sectional, of the same link according to the previous Figure, subjected to the process of cold deformation to obtain a cut surface.
Figure 4B:
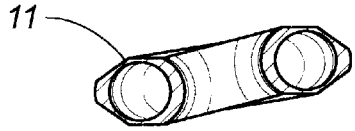
FIG. 4 is a sectional view of a traditional link before being subjected to the process of cold deformation in a moulding station of the type indicated in FIG. 2.
Figure 5:
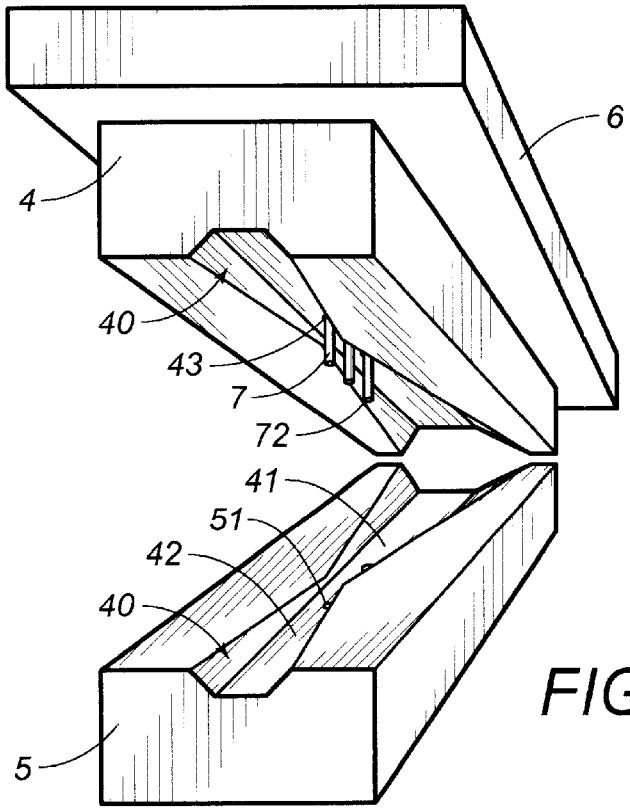
FIG. 5 is a view in perspective of a mould inverted like a utensil for the execution of the described manufacture throughout the chain of hollow links.
Figure 3:
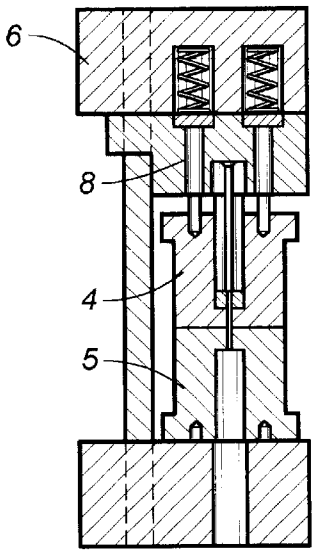
FIG. 3 is a cross sectional view of the manufacturing head according to FIG. 2.
Figure 2:
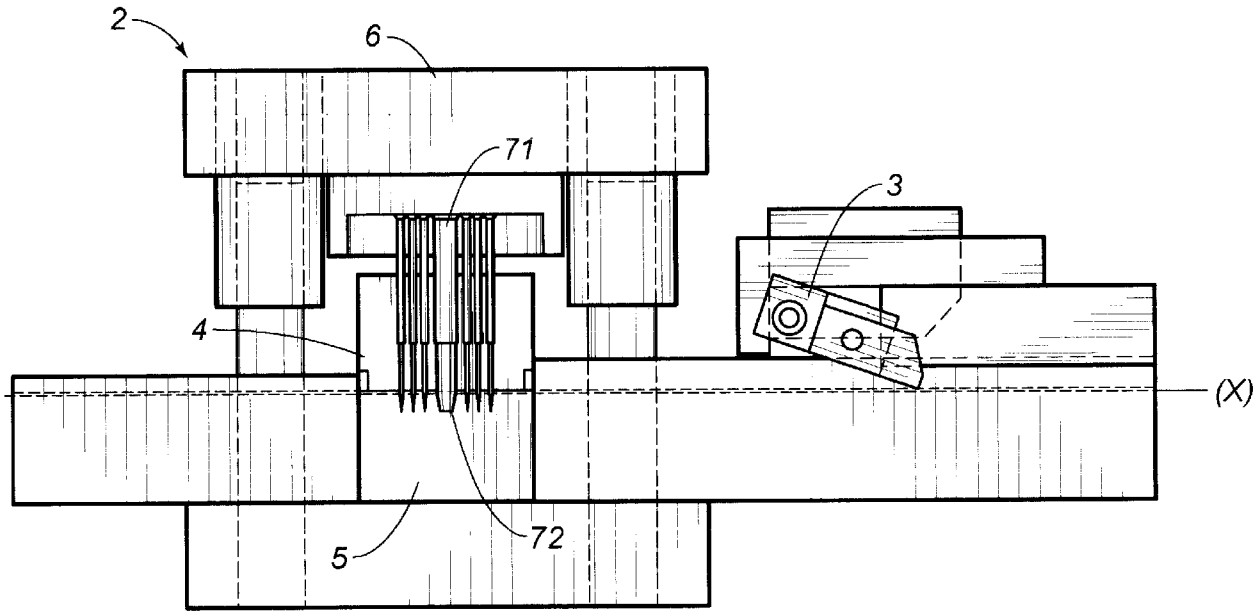
FIG. 2 is a side view of the manufacturing head in a mould station to obtain the diamond effect in a chain of hollow links.

In more detail, the semi-manufactured chain (A) previously folded on the coil is unfolded slowly upstream of the manufacturing head (2) present in the moulding station and advances towards it by means of a mobile guide catch (3). Said catch (3) operatively pushes forward the link that has to be manufactured; Then the catch stops to lift itself up and return to intercept the next link (1) to carry out, consequently, at the end of the manufacture of the previous link, a further step forward. The links (1) are placed in this way in correspondence with the manufacturing head (2) which in this case comprises a mould or chain press (4) that co-operates with an underlying matched mould (5), in which the first (4) is mobile perpendicularly with respect to the second, which is fixed. The manufacturing head (2) illustrated in FIG. 2, in the top part is essentially composed of a supporting and movement body (6) of the utensil group, which in this case comprises the substitutable mould (4) which axially cooperates with at least one core (7). In this case, as many cores (7) as links (1) of the segment of chain (A) can be foreseen linked progressively by the manufacture. Said cores (7), in the present invention, are essentially composed of straight bodies aligned and positioned perpendicularly to the underlying chain (A). At least one part of said cores (7) is destined to be introduced through the orifice of each of the links (1) linked to form said chain (A). In a more detailed form, the cores (7) analogously exchangeable are linked on one side (71) to the body (6) and on the other side they are introduced in the inside of the same number of orifices practised perpendicularly through the underlying mould (4) introducing the longitudinal axis of for advancing said chain (A), so that the termination (72) of each one arises through the openings (43) practised on the side (40) of the mould stamp (4). In relation to the conformation of the inferior extremity (72) of each core (7), it is presented with a reduction with respect to the superior part and can end in some cases with the surfaces inclined that must converge so as to confer on them a conical introduction. In relation to the mobility of the mould (4) on the axis perpendicular with respect to the advancing direction of the chain (A), it is observed that the chain is guaranteed by stopping means (8) elastically manageable placed on the sides of the cores (7). Said stopping means (8) connect the mould (4) with the body (6) of the manufacturing head (2). Consequently, to carry out the manufacture on the link of the chain (A), the whole of the manufacturing head (2) composed of the body (6) that supports and moves the mould (4) and the respective cores (7) interacts with an underlying matched mould (5) housed in logical correspondence throughout the longitudinal axis (x) of the advancing the chain (A).

Also, said matched mould (5) is obviously exchangeable, and to allow a complete movement of the cores (7) the matched mould is provided with its top part, logically coinciding with those situated in the top part that have as many openings (51) as extremities (72) of the cores (7) that house the links (1) coaxially during the deformation phase. In this case, it is also observed that contrary to the previous part, the matched mould (5) does not carry out any movement on the vertical axis.

The main characteristic of the two imprints that are present both in the mould (4) and in the matched mould (5) consists in foreseeing a section that is capable of printing laterally on each of the links (1) of a chain (A) a plurality of flat sides (11), substantially inclined with respect to the eventual top and bottom surfaces formed on the horizontal plane. This deformation is carried out in the case of each link with a certain progression, as the stamp (40), upstream of the mould stroke foresees the convergent entry channel (41) to separate itself after a uniform intermediate segment (42), starting up the moulded links (1) towards the exit.

Operatively, as an example, a manufacture cycle to obtain the controlled deformation of a chain (A) foresees the following manufacture phases:

Advancing step by step of a semi-manufactured product chain (A) with hollow links (1), through a cold moulding station downstream;

At each stop, in the moulding station, carrying out in logical correspondence the descent towards a matched mould (5), of at least one core (7) and at least one mould (4), in which said core (7) can be moved perpendicularly through the mould (4), placed inside each individual link (1) of the corresponding segment of chain (A), disposing the perimeter surface in contact with the interior perimeter of each link;

Ending of the descent of the mould (4), with progressive deformation and contextual disposition of each link (1);

For this reason, partially raising the core (7), with the mould (4) and matched mould (5) remaining in closed position;

Ending of the ascension of the core (7) until extraction of the corresponding link (1), with ascension towards the top part of the mould (4) for a corresponding cycle that must be carried out on the segment of successive links.

Repeating the advancing step by step of the chain (A) through the cold moulding station.

I claim:

1. A process for creating a diamond effect on a chain having hollow links comprising:

forming a mold having at least one core and a matched mold;

positioning a link of the chain into an interior of said mold; and moving the core through an interior of the hollow link so as to contact an inside perimeter of said link and to deform said inside perimeter.

2. The process of claim 1, further comprising:

descending said core toward said matched mold;

moving said core perpendicularly through said mold so as to contact said interior perimeter;

progressively deforming the link during said step of descending;

ascending the core toward a top of said mold; and extracting the link from the mold.

3. The process of claim 1, further comprising:

advancing the chain through said mold in a step-by-step manner.

4. The process of claim 1, further comprising:

forming the link so as to have a plurality of non-horizontal flat sides laterally on the link.

5. An apparatus for producing a diamond effect on a precious metal product comprising:

a manufacturing head having a mold with an underlying matched mold, said matched mold being fixed, said mold being moveable perpendicularly with respect to said matched mold, said manufacturing head having a movement body of said mold, said movement body cooperating axially with at least one core, the core having an extremity linked at a top end thereof to said movement body; and a chain having at least one link with an inside perimeter, the link being received interior of said mold, the core being moveable through said interior of the link so as to contact said inside perimeter and to deform said inside perimeter.

6. The apparatus of claim 5, said movement body having a number of the cores equal to a number of the links received interior of said mold, the core being a straight body aligned with and positioned perpendicularly to said chain.

7. The apparatus of claim 5, the core having a lower extremity introduceable through said interior of the link.

8. The apparatus of claim 5, the core being mountable perpendicularly into at least one orifice formed in said mold.

9. The apparatus of claim 5, said mold being perpendicularly moveable relative to a direction of advancement of said chain therethrough, the apparatus further comprising:

a stop member elastically connecting said mold to said movement body of said manufacturing head.

10. The apparatus of said claim 5, said matched mold having a number of the orifices equal to a number of the cores extending from said movement body.

11. The apparatus of said claim 5, said mold and said matched mold each having a stamp means therein, said stamp means for laterally imprinting a plurality of substantially inclined flat sides on the link.

12. The apparatus of claim 11, said stamp means being upstream of an entry channel for said chain converging along an interior of said mold, said stamping means being downstream of an exit channel in said mold, said exit channel converging toward said entry channel.

* * * * *